US009863683B2

(12) United States Patent
Baumbach et al.

(10) Patent No.: US 9,863,683 B2
(45) Date of Patent: Jan. 9, 2018

(54) ICE CUBE TRAY ASSEMBLY

(71) Applicant: Crystal Cubes LLC, Los Angeles, CA (US)

(72) Inventors: John Joseph Baumbach, Los Angeles, CA (US); Douglas Carl Allan, Calistoga, CA (US); Brendan Hingston Lake, Venice, CA (US); Justin Eakes, Olathe, KS (US)

(73) Assignee: Crystal Cubes LLC, Los Angeles, CA (US)

( * ) Notice: Subject to any disclaimer, the term of this patent is extended or adjusted under 35 U.S.C. 154(b) by 63 days.

(21) Appl. No.: 15/172,519

(22) Filed: Jun. 3, 2016

(65) Prior Publication Data

US 2016/0356536 A1 Dec. 8, 2016

Related U.S. Application Data

(60) Provisional application No. 62/170,660, filed on Jun. 3, 2015.

(51) Int. Cl.

| | |
|---|---|
| ***F25C 1/24*** | (2006.01) |
| ***F25C 1/18*** | (2006.01) |
| *F25C 5/06* | (2006.01) |

(52) U.S. Cl.

CPC ..... *F25C 1/24* (2013.01); *F25C 1/18* (2013.01); *F25C 5/06* (2013.01); *F25C 2400/06* (2013.01)

(58) Field of Classification Search

CPC ..... F25C 1/18; F25C 1/24; F25C 2400/06

See application file for complete search history.

(56) References Cited

U.S. PATENT DOCUMENTS

| | | | | |
|---|---|---|---|---|
| 2,389,317 | A * | 11/1945 | Kitto | F25C 1/24 249/127 |
| 2,415,451 | A * | 2/1947 | Synnestvedt | F25C 1/24 249/128 |
| 5,364,063 | A * | 11/1994 | Nishimura | F25C 1/18 249/119 |
| 6,357,720 | B1 | 3/2002 | Shapiro et al. | |
| 2009/0152438 | A1 | 6/2009 | Chu | |
| 2015/0107275 | A1 | 4/2015 | Papalia | |

* cited by examiner

*Primary Examiner* — James Sanders

(74) *Attorney, Agent, or Firm* — The Watson I.P. Group, PLC; Jovan N. Jovanovic; Vladan M. Vasiljevic

(57) ABSTRACT

An ice cube tray assembly having an insulating box, a lower chamber and an upper chamber. The insulating box having a base and an upstanding structure, with a cavity. A top surface has an inner and outer perimeter, with the inner perimeter defining the opening of the cavity. The lower chamber includes an upper deck portion and container structure depending therefrom. The upper chamber includes a top wall and an inner container structure depending from the top wall. The upper and lower chambers are positioned in sealing engagement.

18 Claims, 12 Drawing Sheets

ICE CUBE TRAY ASSEMBLY

CROSS-REFERENCE TO RELATED APPLICATION

This application claims priority from U.S. Prov. Pat. App. Ser. No. 62/170,660 filed Jun. 3, 2015, entitled "Ice Tray For Making Clear Ice In A Freezer," the entire disclosure of which is incorporated by reference in its entirety.

BACKGROUND OF THE DISCLOSURE

1. Field of the Disclosure

The disclosure relates in general to refrigeration equipment, and more particularly, to an ice cube tray assembly for the formation of ice cubes or other frozen (or solidified material) that is substantially free of impurities, air bubbles and the like. In the instance of water, the resulting ice is quite clear and substantially free of impurities that result in clouding or bubbling that is visible therewithin.

2. Background Art

Forming ice cubes or the like for drinks (typically for alcoholic based beverages) is well known in the art. Recently, there has been an increased desire to form ice cubes that have a structure that is substantially visibly clear, free of air bubbles and impurities.

Certain solutions have been developed that form ice cubes that have such structures. It is known that such ice cubes can be formed by directionally freezing the water to, essentially push the impurities out of the water prior to freezing. Such solutions are shown in, among other references, U.S. Pat. No. 6,357,720 issued to Shapiro et al., as well as in U.S. Pat. App. Pub. Nos. 2009/0152438 published to Chu and 2015/0107275 published to Papalia, the entire specification of each of which is incorporated by reference in their entirety herein.

Problematically, such solutions, while providing advancements do not provide for the ease of use and the consistent formation of ice cubes that is provided for under the present disclosure.

SUMMARY OF THE DISCLOSURE

The disclosure is directed to an ice cube tray assembly. The ice cube tray assembly includes an insulating box, a lower chamber and an upper chamber. The insulating box has a base and an upstanding structure. The upstanding structure has an inner surface defining a cavity and a top surface having an inner perimeter and an outer perimeter. The inner perimeter defines the opening of the cavity. The lower chamber includes an upper deck portion with a container structure depending therefrom. The container structure has an upper portion and a lower portion, with an inward flange extending from a lower end of the upper portion to the upper end of the lower portion.

The upper deck portion includes a lower surface overlayingly abutting the top surface, with the container structure extending into the cavity of the insulating box. The upper chamber includes a top wall and an inner container structure depending from the top wall.

The top wall has an inner surface overlayingly abutting an upper surface of the upper deck portion of the lower chamber, with the inner container structure defining a cavity and having an outer surface which is sealingly engaged with an inner portion of the lower chamber. The upper chamber includes at least one opening extending therethrough so as to place the cavity of the upper chamber in fluid communication with the lower portion of the lower chamber.

In some configurations, an outer surface of the lower chamber is spaced apart from the inner surface of the upstanding structure of the insulating base so as to define an assembled gap.

In some configurations, the insulating box has at least one pair of opposed grasping channels extending into the top surface thereof. The upper deck portion of the lower chamber includes at least one pair of grasping tabs corresponding to at least one of the at least one pair of opposed grasping channels.

In some configurations, the upper chamber further includes an outer depending skirt depending from an outer perimeter of the top wall thereof. The depending skirt is configured to overlie an outer surface of the upstanding structure of the insulating box. At least one pair of access openings corresponding to the at least one of the at least one pair of opposed grasping channels of the lower chamber.

In some configurations, the upper chamber includes a plurality of dividing ribs so as to define a plurality of sub-chambers. At least one opening positioned within each sub-chamber.

In some configurations, the lower chamber includes a plurality of dividing ribs to define a plurality of sub-chambers which correspond to the dividing ribs of the upper chamber.

In some configurations, the plurality of dividing ribs of the lower chamber include an opening so as to place the sub-chambers of the lower chamber in fluid communication.

In some configurations, each sub-chamber of the upper chamber includes at least four spaced apart openings.

In some configurations, each sub-chamber of the upper chamber is substantially cubic in configuration.

In some configurations, four sub-chambers are defined in the upper chamber.

In some configurations, the insulating box comprises an outer shell and an inner insulative member, with the outer shell surrounding the inner insulative member.

In some configurations, the depending portion of the upper portion of the container structure includes a plurality of walls. The depending portion of the lower portion including a plurality of walls extending from a flange that is positioned at a lower end of the upper portion. The lower portion further including a base wall having an upper surface and lower surface.

In some configurations, the base wall is substantially parallel to the upper deck portion.

In some configurations, each of the depending portion of the upper portion and the lower portion defines a substantially square cross-sectional configuration.

In some configurations, the lower surface of the base wall includes a plurality of bottom pegs, the bottom pegs configured to engage with an upper surface of the base of the insulating base, so as to space the base wall therefrom.

In some configurations, the flange and the base wall are substantially parallel to each other and spaced apart from each other.

In some configurations, the upper chamber further includes a sealing perimeter edge extending about the perimeter of the inner container structure proximate the lower end thereof.

In some configurations, the sealing perimeter edge is substantially square.

BRIEF DESCRIPTION OF THE DRAWINGS

The disclosure will now be described with reference to the drawings wherein.

DETAILED DESCRIPTION OF THE DISCLOSURE

Figure 1:
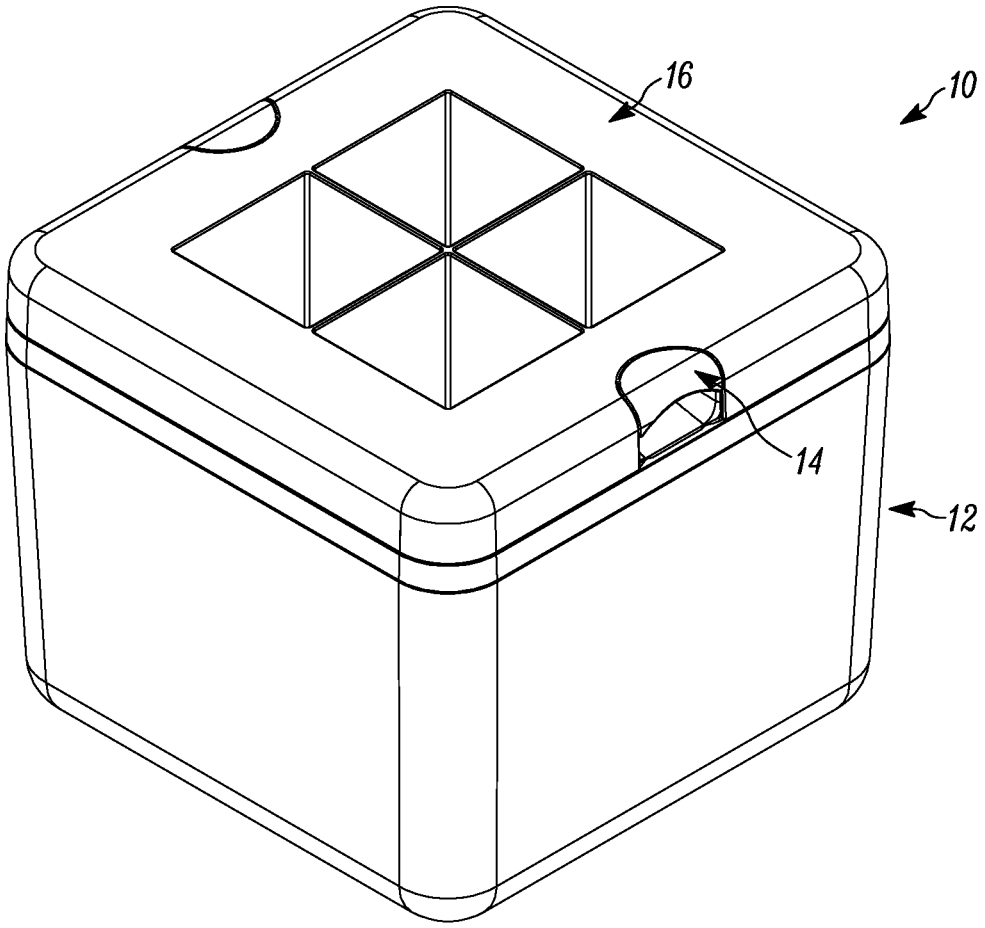
FIG. 1 of the drawings is a perspective view of the ice cube tray assembly of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the ice cube tray assembly is shown generally at 10. The ice cube tray assembly comprises insulating box 12, lower chamber 14 and upper chamber 16. The insulating box includes base 20 and upstanding structure 22. In the configuration shown, the base and the upstanding structure generally comprises a molded member that may include an outer skin and an inner insulation member. The inner insulation member may comprise a foam insulation, with the outer skin comprising a rigid polymer based material. In other configurations, other materials may be utilized. Additionally, in further configurations, the insulating box 12 may be formed from a single material (in a single component or in multiple components that are coupled or otherwise joined together.

As to dimensional configuration, the insulating box 12 includes base 20 includes upper surface 23 and lower surface 24. The upstanding structure 22 includes walls, such as walls 26, that include a lower end 30 and an upper end 31. In the configuration shown, four walls are presented, in a generally square configuration, that may be upwardly conical in shape. The base and upstanding structure together define an outer surface 48 and an inner surface 49. The inner surface 49 defines cavity 39 with an opening at the upper end 31 thereof. The upstanding structure, at the upper end 31 includes top surface 27 which includes a ring-like surface having an inner perimeter 36 and an outer perimeter 38. The configuration of the ring-like surface is substantially rectangular. In the configuration shown, the ring-like surface is substantially planar and parallel to a plane defined by the base 20 and spaced apart therefrom. It will be understood that while a generally upwardly conical square configuration is shown, other shapes and configurations are contemplated, including, but not limited to other configurations which can define a cavity with an opening proximate the top thereof.

Extending downwardly from the outer perimeter 38 of the top surface 27 is upper recessed rim 28 which includes upper end 40 and lower end 42. The lower end 42 generally terminates with flange 43. Grasping channels, such as grasping channels 29*a*, 29*b* are positioned on opposing sides of each other and extend into the upper recessed rim 28 and the top surface 27 so as to provide access to the user between the insulating box and the lower chamber, to, as will be explained, remove the lower and upper chambers 14, 16 from the insulating box.

Figure 2:
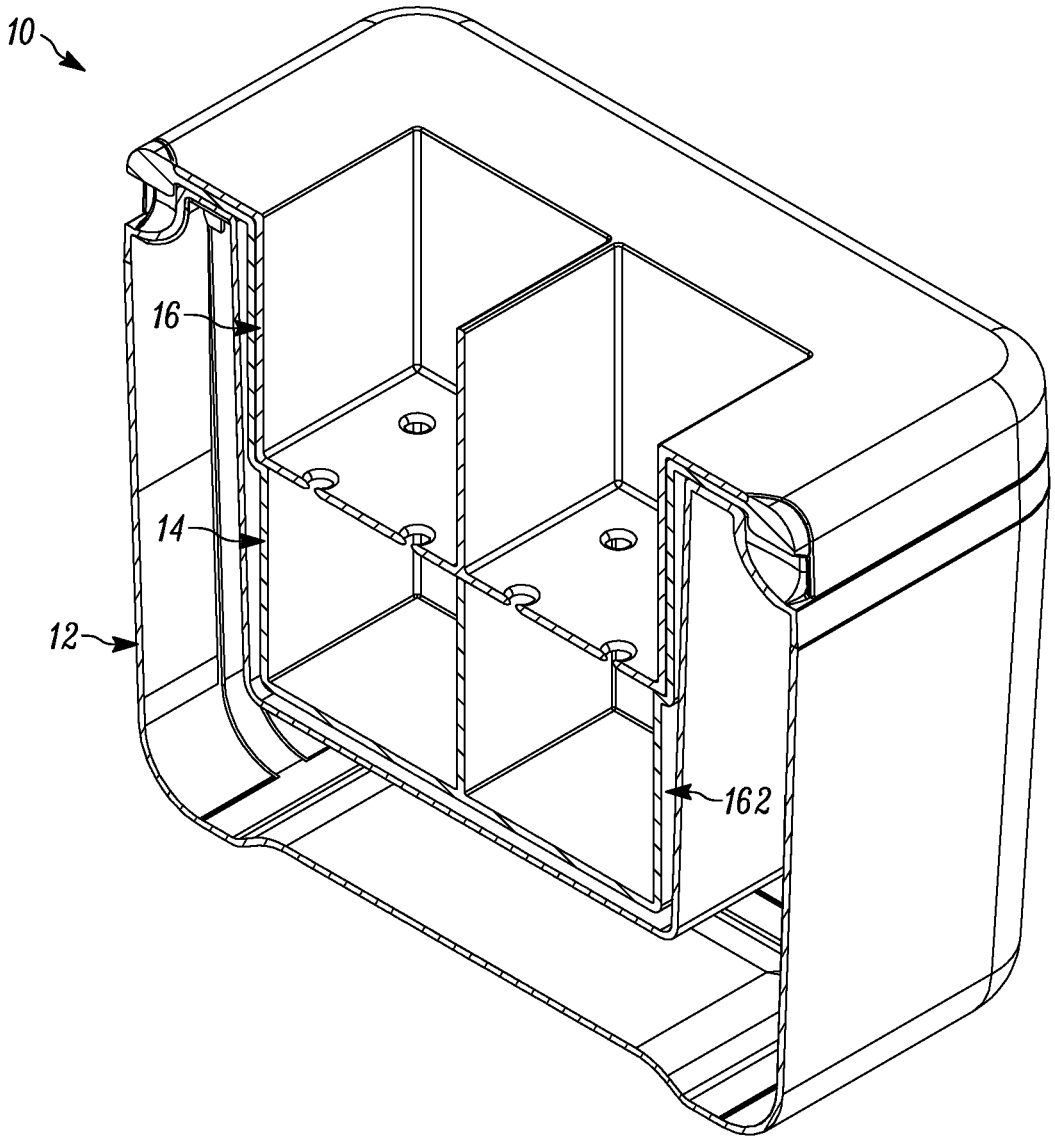
FIG. 2 of the drawings is a cross-sectional perspective view of the ice cube tray assembly of the present disclosure.
Figure 3:
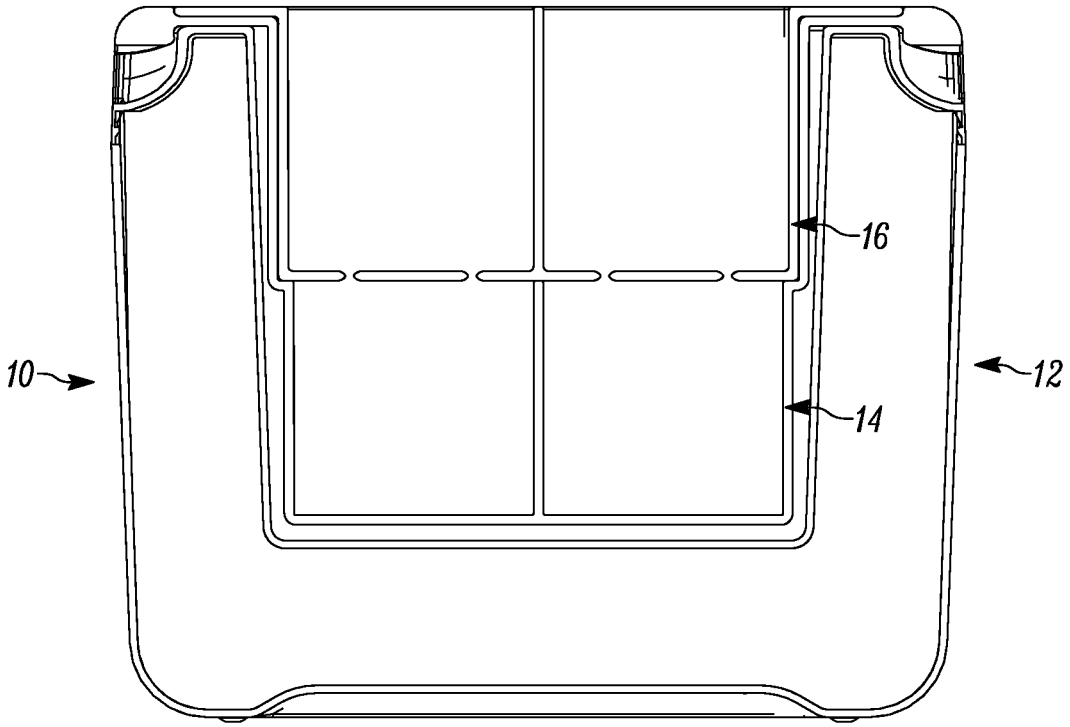
FIG. 3 of the drawings is a cross-sectional view of upper chamber of the ice cube tray assembly of the present disclosure.
Figure 4:
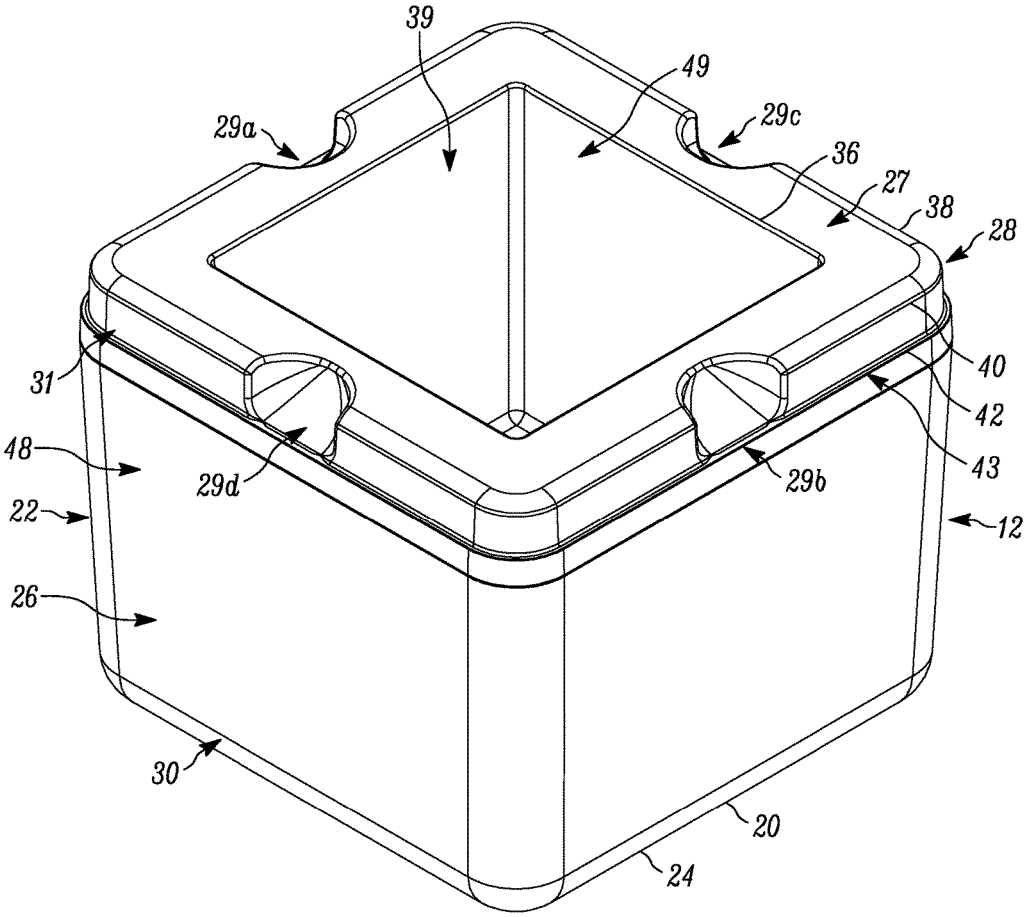
FIG. 4 of the drawings is a perspective view of the upper chamber of the ice cube tray assembly of the present disclosure.
Figure 5:
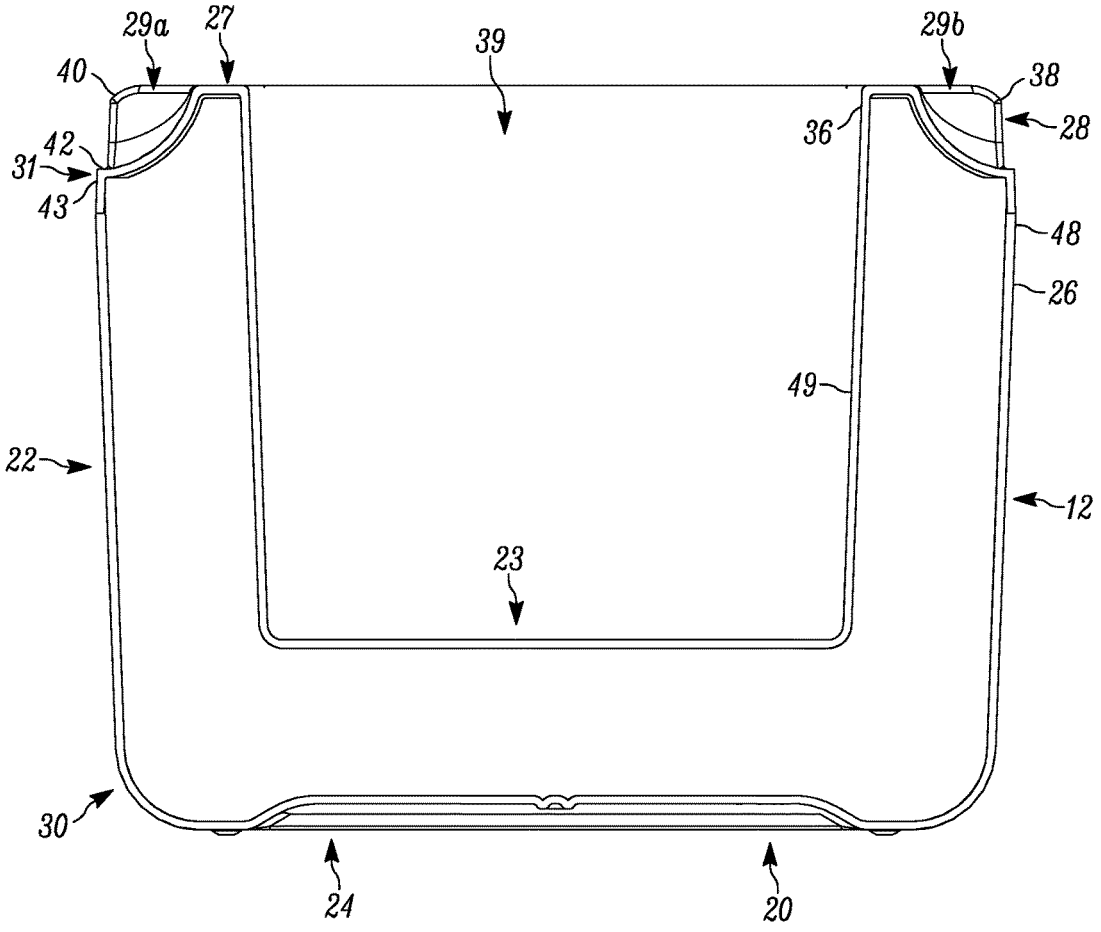
FIG. 5 of the drawings is a cross-sectional view of the upper chamber of the ice cube tray assembly of the present disclosure.
Figure 6:
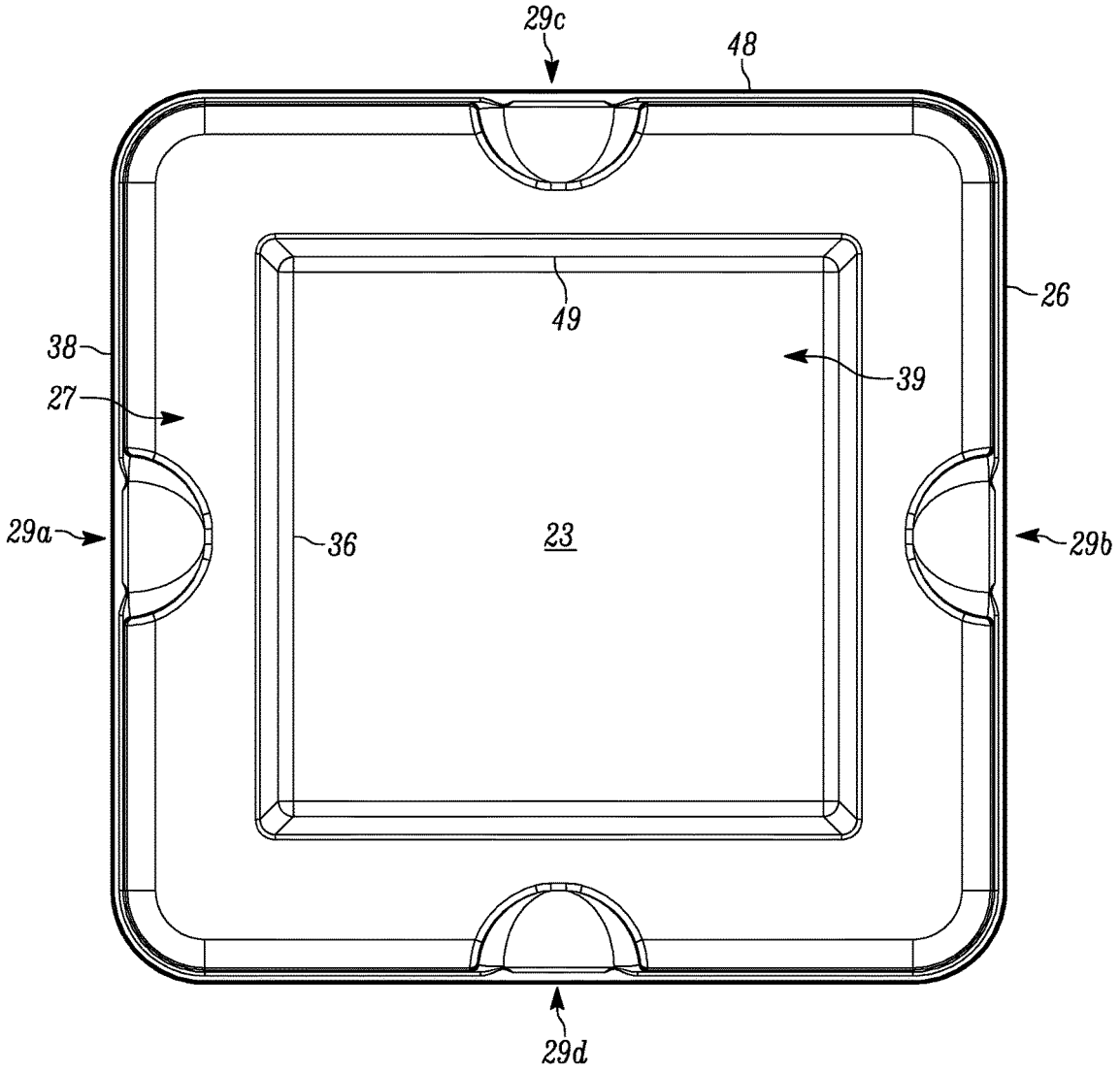
FIG. 6 of the drawings is a top plan view of the upper chamber of the ice cube tray assembly of the present disclosure.
Figure 7:
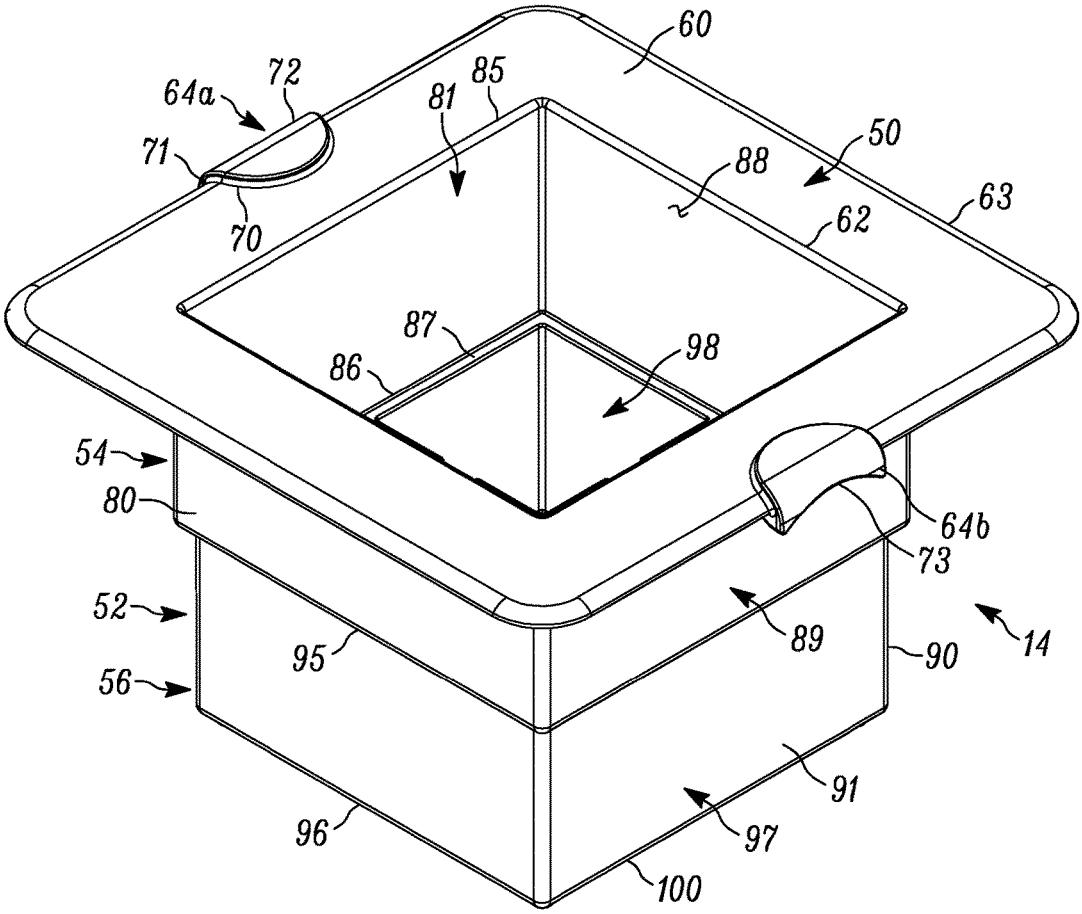
FIG. 7 of the drawings is a perspective view of the lower chamber of the ice cube tray assembly of the present disclosure.
Figure 8:
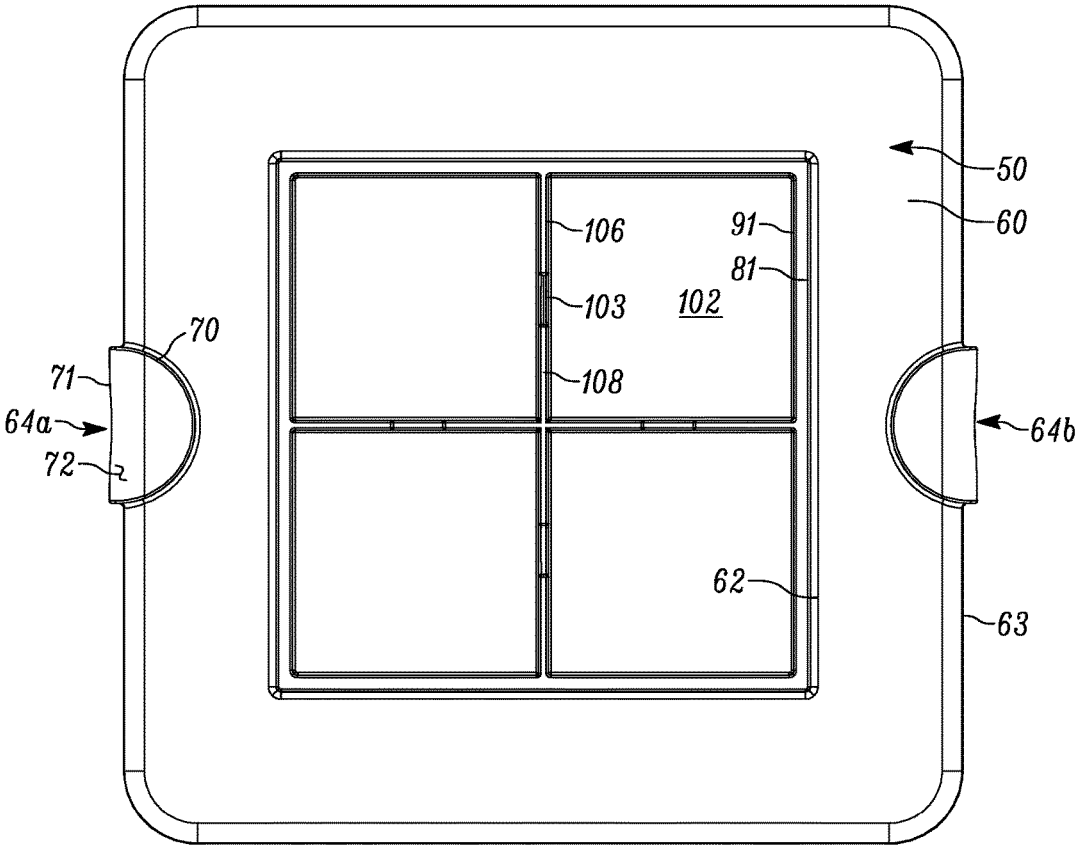
FIG. 8 of the drawings is a top plan view of the lower chamber of the ice cube tray assembly of the present disclosure.
Figure 9:
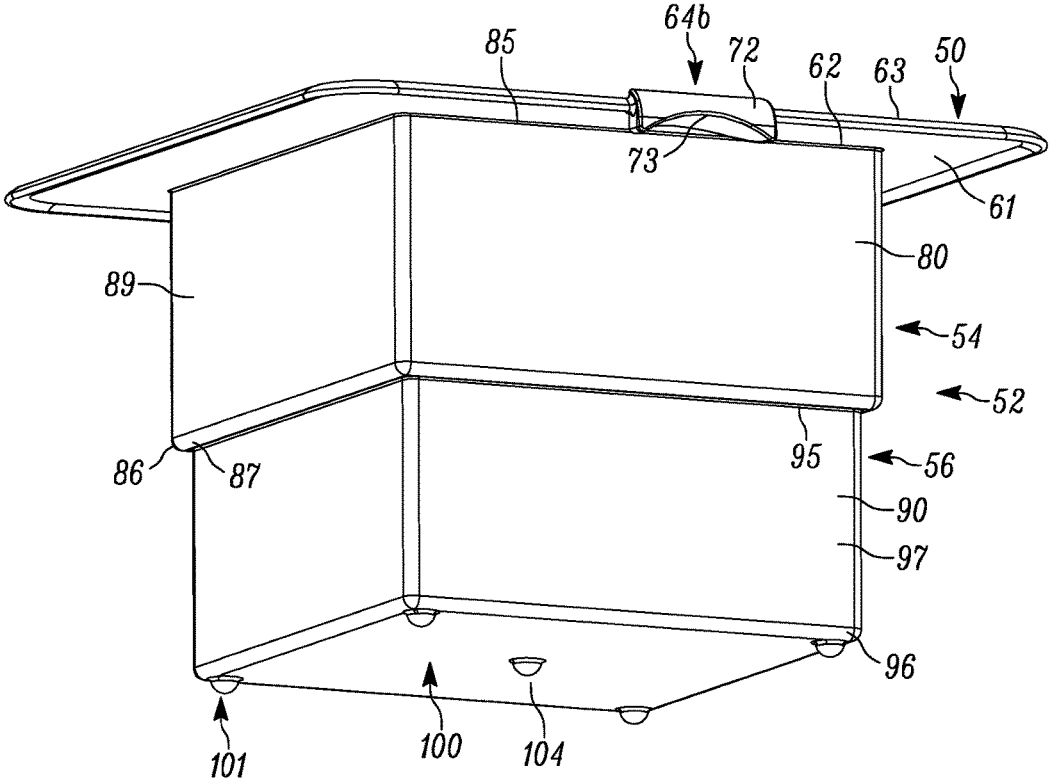
FIG. 9 of the drawings is a bottom perspective view of the lower chamber of the ice cube tray assembly of the present disclosure.
Figure 10:
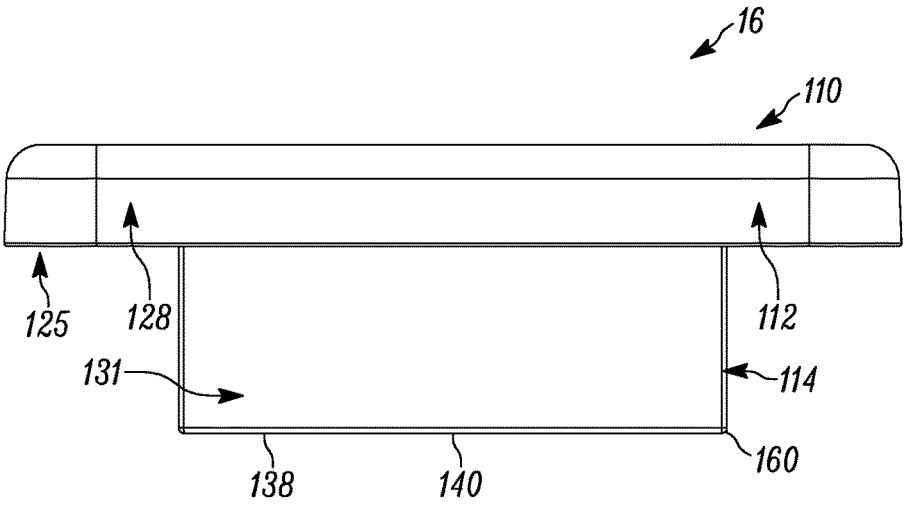
FIG. 10 of the drawings is a side elevational view of the upper chamber of the ice cube tray assembly of the present disclosure.
Figure 11:
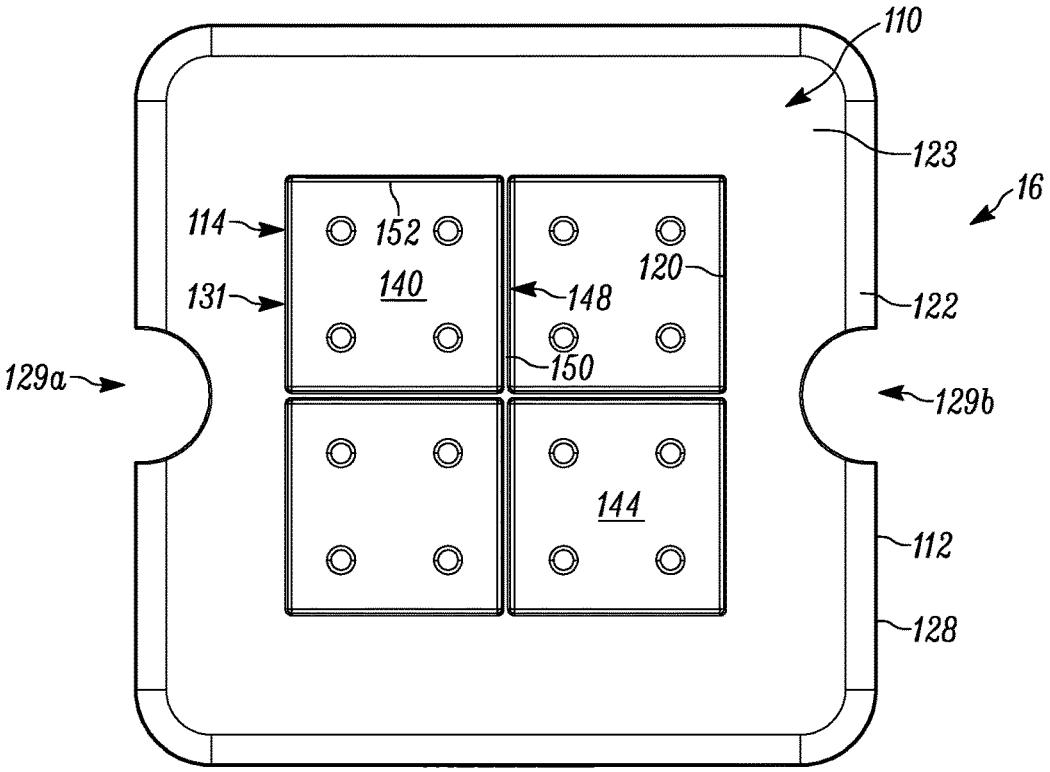
FIG. 11 of the drawings is a top plan view of the upper chamber of the ice cube tray assembly of the present disclosure.
Figure 12:
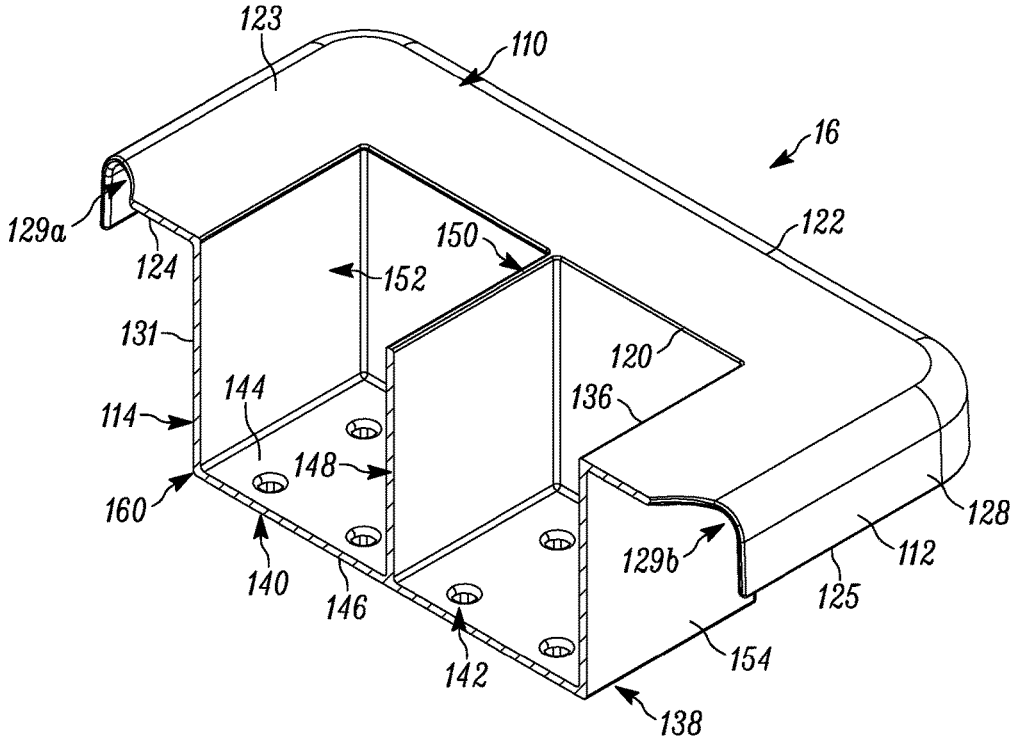
FIG. 12 of the drawings is a cross-sectional perspective view of the upper chamber of the ice cube tray assembly of the present disclosure.
Figure 13:
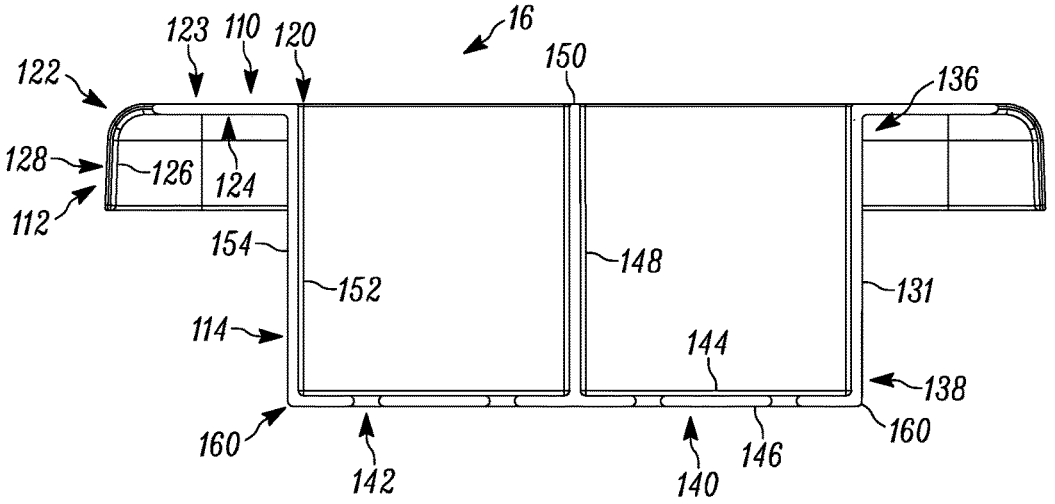
FIG. 13 of the drawings is a cross-sectional view of the upper chamber of the ice cube tray assembly of the present disclosure.
Figure 14:
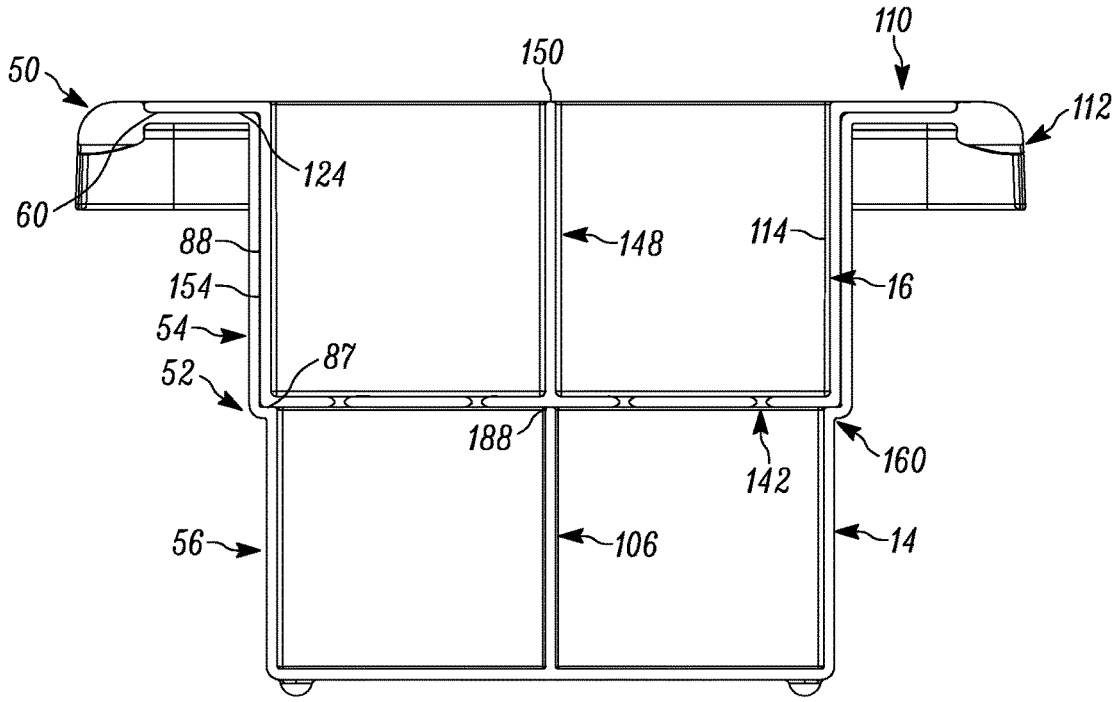
FIG. 14 of the drawings is a cross-sectional view of the combined and joined upper and lower chambers of the ice cube tray assembly of the present disclosure.

The lower chamber is shown in FIG. 2 as comprising upper deck portion 50 and container structure 52. The upper deck portion defines a flange having upper surface 60, lower surface 61 that cooperatively define inner perimeter 62 and outer perimeter 63. The upper deck portion is configured to overlie the top surface 27 of the insulating box 12. The upper deck portion 50 includes grasping tabs 64*a*, 64*b* which are configured to correspond to the grasping channels 29*a*, 29*b* of the insulating box. Each grasping tab includes inner perimeter 70, outer portion 72, upper surface 72 and lower surface 73. The configuration is made to also matingly engage with/correspond to structures of the upper chamber 16.

The container structure depends from the upper deck portion (and is integrally molded therewith), and includes upper portion 54 and lower portion 56. The upper portion 54 includes depending structure 80 having a plurality of walls 81 that extend from upper end 85 to lower end 86. At the lower end, an inward flange 87 is disposed. The walls of the depending structure define an inner surface 88 and an outer surface 89. The lower portion 56 extends below the inward flange 87 and includes corresponding depending structure 90. The depending structure 90 includes walls, such as wall 91 that extends from upper end 95 to lower end 96 and terminates at base wall 100. The wall structure includes outer surface 97 and inner surface 98. The base wall 100 includes upper surface 102 and lower surface 104. The upper and lower portion are substantially continuous, such that they collectively define a substantially fluid tight container structure, with an opening corresponding to the upper deck portion. The lower surface of the base wall may include a plurality of bottom pegs such as bottom pegs 101 which provide a spacer from the upper surface of the base of the insulating box, while supporting the lower chamber in the desired position.

A plurality of ribs (in this case two ribs that extend from side to side, intersecting in the middle) are formed within the lower portion 56. In the configuration shown, four substantially identical ribs are formed, each with an upper edge 108, which generally corresponds to the inward flange 87. It will be understood that channels, such as channels 103 may be disposed in each of the dividing ribs so as to provide for fluid communication of the regions on either side of the dividing ribs.

The upper chamber 16 is shown as including top wall 110, outer depending skirt, and inner container structure 114. The top wall 110 includes inner perimeter 120 and outer perimeter 122. The top wall 110 is configured to overlie the upper deck portion 50 of the lower chamber, and includes outer surface 123 and inner surface 124. The outer dependent skirt extends from the outer perimeter 122 and extends downwardly along the upper recessed rim 28 of the insulating box 12. The outer dependent skirt 112 extends to lower edge 125, and includes inner surface 126 and outer surface 128. The outer dependent skirt includes opposing access openings 129*a,* 129*b* that correspond to the grasping channels 29*a,* 29*b* and to the grasping tabs 64*a,* 64*b*.

The inner container structure 114 includes depending walls, such as wall 131. The walls define upper end 136 and lower end 138, and extend to base wall 140. The walls include inner surface 152 and outer surface 154. The lower end 138 terminates with sealing perimeter edge 160, which, as will be explained, is configured to sealingly engage the inward flange 87 of the upper portion of the container structure 52 of the lower chamber.

The base wall 140 includes openings 142 that are disposed therealong to place the inner container structure in fluid communication with the lower portion 56 of the lower chamber 14. The base wall includes upper surface 144 and lower surface 146. A plurality of dividing ribs 148 extend between opposing walls and intersect in the middle of the structure to form four separate chambers that are substantially cubic in configuration. The dividing ribs 148 each include upper edge 150. The structure is configured to substantially match the dividing ribs 106 of the lower portion 56 of the container structure 52 of the lower chamber. It will be understood that the walls and the dividing ribs of the inner container structure of the upper chamber cooperatively define the structural configuration of the resulting ice cubes.

To assemble the ice cube tray assembly, the insulating box 12 is provided. Once provided, the lower chamber 14 is inserted into the cavity 39 of the insulating box. Upon installation, the upper deck portion 50 overlies the top surface 27 of the insulating box in overlying abutment. The grasping tabs 64*a,* 64*b* correspond and overlie two of the grasping channels 29*a,* 29*b*. In the configuration shown, the outer surface of each of the upper and lower portion of the container structure 52 of the lower chamber is spaced apart from the inner surface 49 formed by the upstanding structure 22 of the insulating box 12 so as to define an assembled gap 162.

Next, the upper chamber 16 is mated to the lower chamber 14. This is achieved by directing the upper chamber into the upper portion 54 of the container structure 52. Eventually, the sealing perimeter edge 160 of the upper chamber 16 sealingly abuts the inward flange 87 of the depending structure 80 of the lower chamber 14 to minimize passage of fluid therebetween (and preferably preclude). At the same time, the outer surface 154 generally overlies and abuts the inner surface 88 of the upper portion of the lower chamber 14 so as to minimize (and preferably preclude) the passage of fluid therebetween. At the same time, the inner surfaced 124 of the top wall 110 of the upper chamber 16 abuttingly overlies the upper surface 60 of the upper deck portion 50 of the lower chamber 14. Additionally, the outer depending skirt 112 extends over the upper recessed rim 28 with the lower edge 128 of the outer depending skirt engaging the lower end 42 of the upper recessed rim. In the configuration shown, the outer surface 48 of the insulating box is flush with the outer surface 128 of the outer depending skirt of the upper chamber 16 inasmuch as the thickness of the latter corresponds to the flange 43 of the upper recessed rim 28. The structure is ready for use.

In operation of the device, once the device is assembled, water or a water based mixture or solution (or another fluid that can change phase to a solid) is introduced into the ice cube tray assembly 10. In particular, as water is introduced into the upper chamber 16, the water is directed by gravity through the openings 142 of the base wall and into the lower portion of the container structure of the lower chamber 14. The lower chamber is filled (and in the configuration shown, each of the four separate sub-chambers formed by the walls and the dividing ribs). Eventually, the water rises within the upper chamber sub-chambers that are formed by the walls and the dividing ribs. The fluid is filled until the desired level is reached in the upper chamber. With the openings 142 in the upper chamber and with the channels 103 in the lower chamber, the level in each of the sub-chambers of the upper chamber 16 is equalized. It is generally preferred to maintain the level of the water just below the upper end 136 of the upper chamber as water and other water based fluids expand when they phase change from a room temperature liquid to a solid. As such, leaving some such room allows for expansion.

The entire ice cube tray assembly 10 is inserted into a freezer or other location wherein the temperature is below the freezing point of the fluid, the fluid begins to cool and eventually phase change. Due to the insulating box and the insulative properties thereof, as compared to the open top, the fluid begins to freeze from the top downwardly. As such, impurities and the like are pushed downward and into the lower portion of the container structure of the lower chamber 14. Thus, by the time that the upper chamber has frozen from the top end to the bottom end, the impurities that were present in that portion of the tray assembly are pushed entirely down into the lower portion of the lower chamber. The result is that the ice (or other solid) is generally free of impurities. In the case of pure water, the resulting ice is substantially clear and free of air bubbles and impurities.

Once frozen as desired, the user can separate the components. In particular, the user can introduce his or her fingers into the grasping channels 29*a,* 29*b* of the insulating box and pull upwardly dislodging the upper and lower chambers 14, 16 as a unit from the insulting box 12. Once separated, the user can manipulate the upper and the lower chambers to separate the two. It will be understood that the ice (or other solid) formed in the upper chamber is coupled to the lower chamber through the openings 142 in the base wall of the upper chamber. As these openings are each quite small in diameter, this represents a weakened portion, and, as such, the relative movement of the upper chamber and the lower chamber, breaks the upper portions and the lower portions of the ice thereat.

Once the ice has been broken, the user can fully separate the upper and lower chambers. As these chambers are preferably formed from a flexible polymer based member such as a silicone material or the like, the upper chamber can be manipulated to allow for release of the ice (or other solid) maintained therein. Once separated and removed, in the configuration shown, four substantially identical ice cubes each having a substantially transparent cubic configuration are produced.

It will be understood that at this point, the remaining ice can be removed from both chambers and the ice cube tray assembly can be reused. It will be understood that with the present construction, the system is easily reassembled and reused. It will further be understood that the system can be scaled up so that larger cubes, or a greater quantity of the same size (or larger or smaller) cubes can be formed. It will further be understood that other configurational changes can be made. Advantageously, the system allows for the separation of the different components with ease and reassembly is also facilitated. It will be understood that with the mating configuration of the grasping channels and the grasping tab and the access openings of the upper chamber, the removal and reattachment of the upper chamber, the lower chamber and the insulating box can be achieved with ease. Furthermore, the separation can likewise be easily achieved. Further still, the configuration allows for sealed engagement between the components while allowing for expansion by spacing the lower chamber apart from the insulating box, creating an assembled gap therebetween. In addition, the shape of the openings 142 allow for the weakened portion therebetween which facilitates the breaking of the components therebetween.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. An ice cube tray assembly comprising:

an insulating box having a base and an upstanding structure, the upstanding structure having an inner surface defining a cavity, and a top surface having an inner perimeter and an outer perimeter, the inner perimeter defining the opening of the cavity;

a lower chamber including an upper deck portion with a container structure depending therefrom, the container structure having an upper portion and a lower portion, with an inward flange extending from a lower end of the upper portion to the upper end of the lower portion, the upper deck portion including a lower surface overlayingly abutting the top surface, with the container structure extending into the cavity of the insulating box;

an upper chamber including a top wall and an inner container structure depending from the top wall, the top wall having an inner surface overlayingly abutting an upper surface of the upper deck portion of the lower chamber, with the inner container structure defining a cavity and having an outer surface which is sealingly engaged with an inner portion of the lower chamber, the upper chamber including at least one opening extending therethrough so as to place the cavity of the upper chamber in fluid communication with the lower portion of the lower chamber.

2. The ice cube tray of claim 1 wherein an outer surface of the lower chamber is spaced apart from the inner surface of the upstanding structure of the insulating base so as to define an assembled gap.

3. The ice cube tray of claim 1 wherein the insulating box has at least one pair of opposed grasping channels extending into the top surface thereof, with the upper deck portion of the lower chamber including at least one pair of grasping tabs corresponding to at least one of the at least one pair of opposed grasping channels.

4. The ice cube tray of claim 3 wherein the upper chamber further includes an outer depending skirt depending from an outer perimeter of the top wall thereof, the depending skirt configured to overlie an outer surface of the upstanding structure of the insulating box, and including at least one pair of access openings corresponding to the at least one of the at least one pair of opposed grasping channels of the lower chamber.

5. The ice cube tray of claim 1 wherein the upper chamber includes a plurality of dividing ribs so as to define a plurality of sub-chambers, with at least one opening positioned within each sub-chamber.

6. The ice cube tray of claim 5 wherein the lower chamber includes a plurality of dividing ribs to define a plurality of sub-chambers which correspond to the dividing ribs of the upper chamber.

7. The ice cube tray of claim 6 wherein the plurality of dividing ribs of the lower chamber include an opening so as to place the sub-chambers of the lower chamber in fluid communication.

8. The ice cube tray of claim 5 wherein each sub-chamber of the upper chamber includes at least four spaced apart openings.

9. The ice cube tray of claim 5 wherein each sub-chamber of the upper chamber is substantially cubic in configuration.

10. The ice cube tray of claim 9 wherein four sub-chambers are defined in the upper chamber.

11. The ice cube tray of claim 1 wherein the insulating box comprises an outer shell and an inner insulative member, with the outer shell surrounding the inner insulative member.

12. The ice cube tray of claim 1 wherein:

the depending portion of the upper portion of the container structure includes a plurality of walls;

the depending portion of the lower portion including a plurality of walls extending from the flange that is positioned at a lower end of the upper portion, and the lower portion further including a base wall having an upper surface and lower surface.

13. The ice cube tray of claim 12 wherein the base wall is substantially parallel to the upper deck portion.

14. The ice cube tray of claim 13 wherein each of the depending portion of the upper portion and the lower portion defines a substantially square cross-sectional configuration.

15. The ice cube tray of claim 12 wherein the lower surface of the base wall includes a plurality of bottom pegs, the bottom pegs configured to engage with an upper surface of the base of the insulating base, so as to space the base wall therefrom.

16. The ice cube tray of claim 12 wherein the flange and the base wall are substantially parallel to each other and spaced apart from each other.

17. The ice cube tray of claim 1 wherein the upper chamber further includes a sealing perimeter edge extending about the perimeter of the inner container structure proximate the lower end thereof.

18. The ice cube tray of claim 1 wherein the sealing perimeter edge is substantially square.

* * * * *